US006019328A

United States Patent [19]

Allen

[11] Patent Number: 6,019,328

[45] Date of Patent: Feb. 1, 2000

[54] STAY-PUT PEGBOARD ACCESSORY

[76] Inventor: Donald S. Allen, 5216 Kearsdale Rd., Toledo, Ohio 43623

[21] Appl. No.: 09/238,242

[22] Filed: Jan. 27, 1999

[51] Int. Cl.[7] ..... A47B 96/06

[52] U.S. Cl. ..... 248/220.31; 248/220.41; 248/220.43; 248/222.52

[58] Field of Search ..... 248/220.31, 220.41, 248/220.42, 220.43, 221.11, 222.51

[56] References Cited

U.S. PATENT DOCUMENTS

| | | | |
|---|---|---|---|
| D. 312,959 | 12/1990 | Hamann | D8/367 |
| 3,319,917 | 5/1967 | Bilodeau | 248/220.43 |
| 3,409,260 | 11/1968 | Bleed | 248/220.31 |
| 3,813,070 | 5/1974 | Hanson | 248/220.43 |
| 4,105,179 | 8/1978 | Elliot | 248/220.43 |
| 4,343,405 | 8/1982 | Virte et al. | 211/88.01 |
| 4,917,337 | 4/1990 | Gridley | 248/220.43 |

*Primary Examiner*—Derek J. Berger
*Assistant Examiner*—David Heisey

[57] ABSTRACT

A stay-put pegboard accessory with a support member/s, having "L" hook/s, fastened to restraining member/s consisting of vertical restraint/s having either a short or a long stub. The "L" hook/s is inserted into an aperture opening of a pegboard with the support member/s carrying the load of a tool or object. Any force acting on the support member/s while removing the load will be resisted with the "L" hook/s and the restraining member/s preventing the stay-put pegboard accessory from being pulled off the pegboard. The short or long stub on the restraining member/s will prevent any twisting of the support member. The long stub on the restraining member will resist an upward force on the load support.

1 Claim, 3 Drawing Sheets

STAY-PUT PEGBOARD ACCESSORY

BACKGROUND

1. Field of Invention

Figure 1:
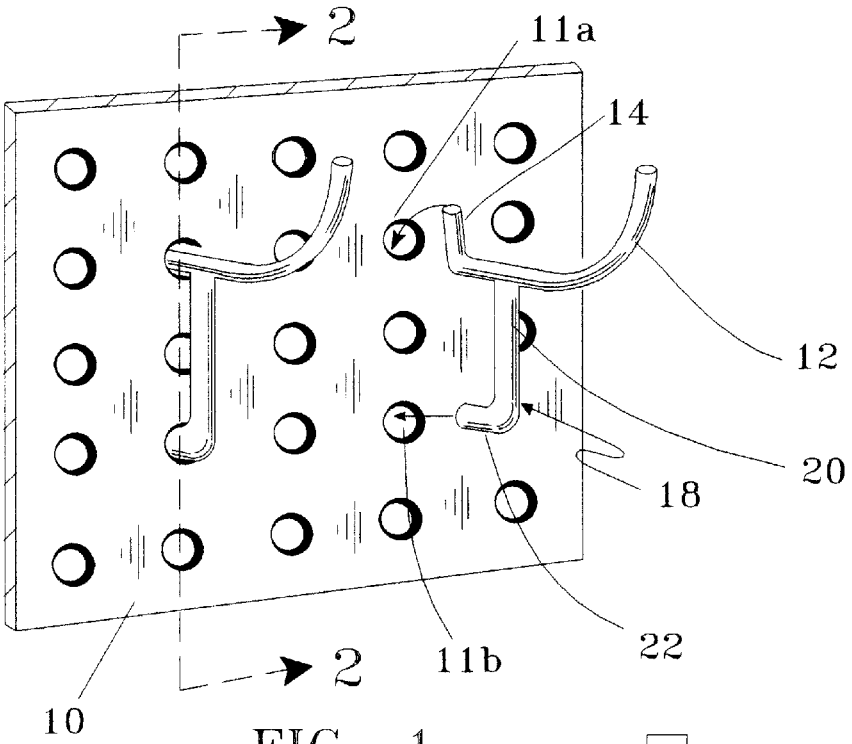

This invention relates to pegboard accessories, specifically to accessories designed that will not be pulled off the aperture boards, also known as pegboards, when the load or object is removed from an accessory.

2. Description of Prior Art

Pegboards are well known in the art with numerous types of pegboard accessories being offered to home owners and contractors for the holding, storing, or hanging of various objects. Early pegboard accessory consisted of a rod bent in the form of a "J" with the upper end of the vertical portion bent in an "S" configuration for inserting into an aperture opening in the pegboard. The pegboard accessory would simply hang on the pegboard with an object hung or supported on the lower portion of the "J". This configuration would allow the pegboard accessory to be easily pulled off the pegboard while removing the object. Forces imparted to the lower support portion of the "J", while removing an object, caused the pegboard accessory to pivot on the "S" and allowing it to be pulled off the pegboard. Normally pegboards are sized in standard sizes, the most common sizes being pegboards having uniform ⅛ inch diameter openings or ¼ inch diameter openings. Often, the openings will become enlarged due to the contractor or home owner inadvertently pulling the accessories off the pegboard and reinstalling the accessory in the same opening. When the item or tool is again removed from the pegboard, because of the looseness of the accessory in the pegboard, the accessory would more easily separate from the pegboard and fall to the floor. In this situation, the user becomes frustrated. Existing accessories designed for the ⅛ inch diameter openings used on pegboards with ¼ inch diameter openings, will fit loosely and can be easily pulled off the pegboard. In an attempt to eliminate the problem of unintentional removal, prior art accessories consist of several spring actuated parts, or separate plastic parts, or more than one separate metal parts, or resilient wire with angles at the ends, or devices requiring tools for each attachment or detachment, or devices that work with only a specific configuration of pegboard. Prior art has had the disadvantages of either: no means of alleviating unintentional removal; or consisting of more than one piece thus requiring two hands for attachment and detachment; or requiring tools for each attachment and detachment; or consisting of numerous separate attached and movable parts increasing manufacturing cost and increasing likelihood of failure or breakage; or consisting of plastic or other more easily breakable materials. The prior attempts to eliminate the problem of unintentional removal has limitations on the holding power of the accessories to stay on the pegboard. The prior art has not addressed the cause for the accessories to become disengaged from the pegboard while removing objects from the accessories. The forces acting on the accessories during removal of an object subjects the accessories to be pivoted on the members which pass through the apertures in the pegboard. The pivoting of the accessories therefore allows the members to become disengaged from the pegboard and often fall to the floor.

Another problem with the prior art accessories having long support members, allows the pegboard to be deflected when heavy loads are applied. The load may then slide on the support member with a chance of it slipping off the accessory.

Objects and Advantages

Accordingly, several objects and advantages of my stay-put pegboard accessory to eliminate the prior art problems of unintentional disengagement of the accessory from the pegboard, when objects held by the accessory are removed, are:

(a) to provide pegboard accessories that will not be accidentally pulled off the pegboard with any force acting on it, including forces perpendicular to the pegboard, while removing an object;

(b) to provide pegboard accessories which increase their holding power on the pegboard as a load or force is applied to the support member;

(c) to provide pegboard accessories that will not diminish their holding power when enlargement of the aperture openings occur for various reasons;

(d) to provide pegboard accessories to be easily removed and repositioned on the pegboard, without the use of any tools and with the use of only one hand;

(e) to provide pegboard accessories sized for lighter pegboards to be used on heavier pegboards, with larger aperture openings, with the same holding power;

(f) to provide one piece pegboard accessories that are simple to use;

(g) to provide pegboard accessories that do not present a safety hazard by being pulled off the pegboard;

(h) to provide pegboard accessories that can be fabricated and welded, cast or molded at a reasonable cost;

(i) to provide a pegboard accessories that minimizes the deflection of the pegboard with heavy loads.

Further objects and advantages will become apparent from a consideration of the ensuring description and drawings.

DRAWING FIGURES

In the drawings, closely related figures have the same numbers but different alphabetic suffixes.

FIG. 1 A perspective view of a pegboard accessory showing the relationship of its various members and with a pegboard accessory mounted on a pegboard.

Figure 2:
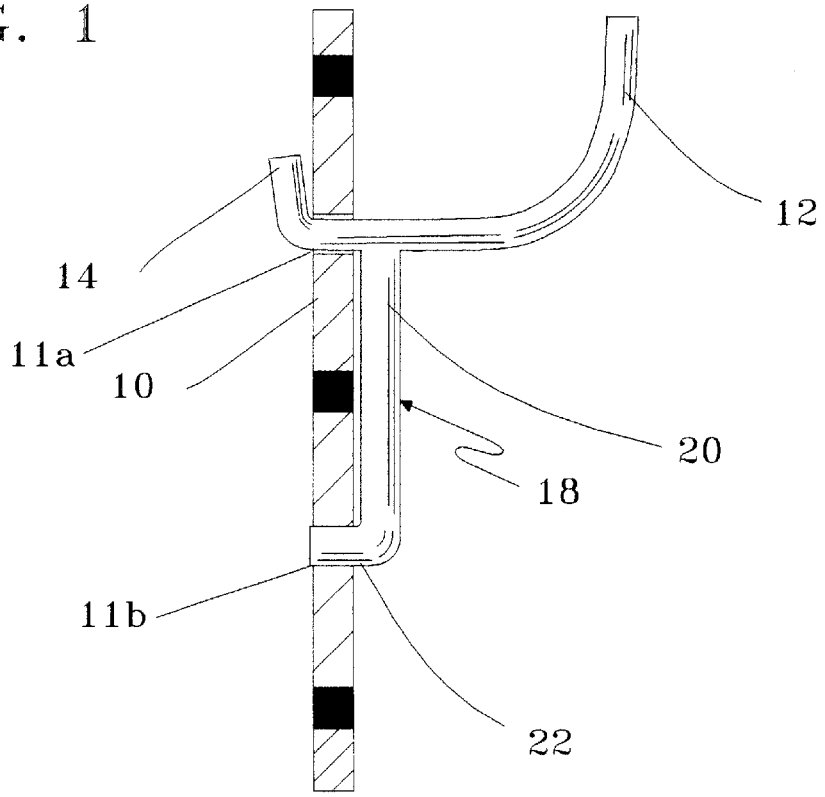

FIG. 2 A sectional elevation view taken in FIG. 1 showing a pegboard accessory mounted on a pegboard.

Figure 3:
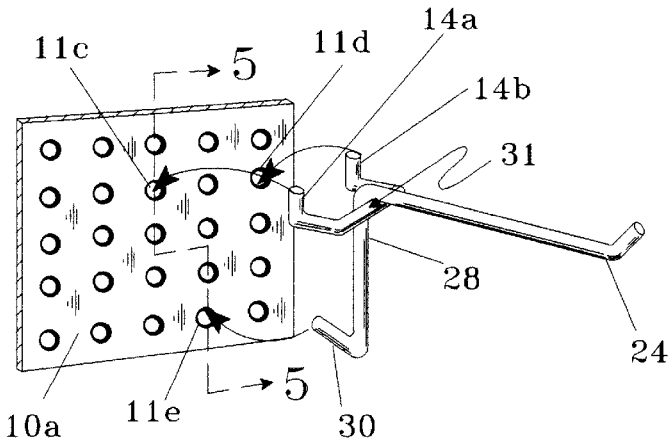

FIG. 3 A perspective view of a pegboard accessory showing other embodiments of the invention and the relationship of the various members with respect to a pegboard.

Figure 4:
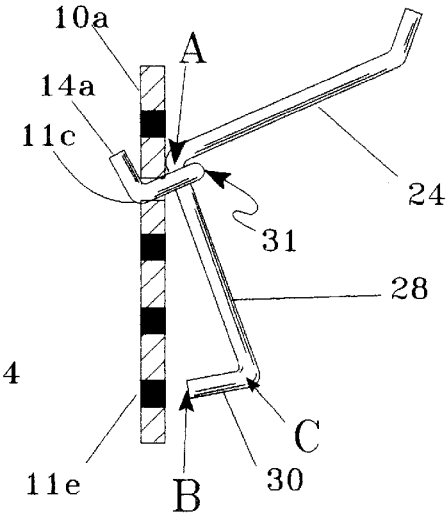

FIG. 4 A sectional elevation view showing a pegboard accessory shown in FIG. 3, partially mounted, and the geometry of its stub.

Figure 5:
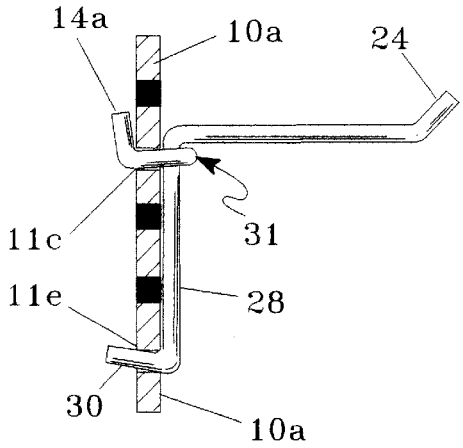

FIG. 5 sectional elevation view taken in FIG. 3 showing an accessory bracket mounted on a pegboard.

Figure 6:
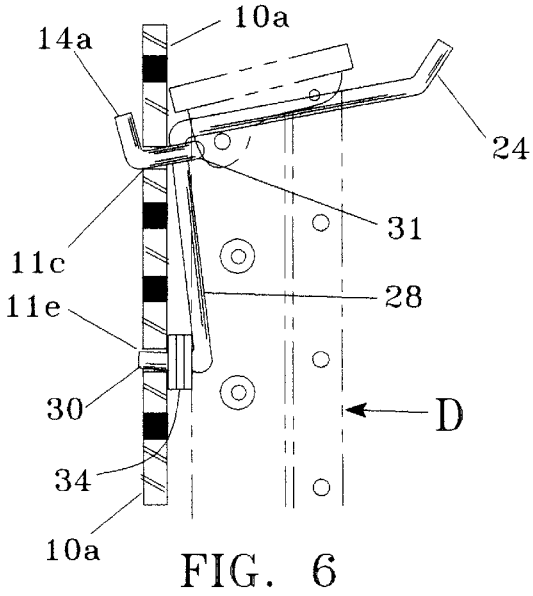

FIG. 6 A sectional elevation view showing a pegboard accessory being used to prevent an object from sliding off the accessory.

Figure 7:
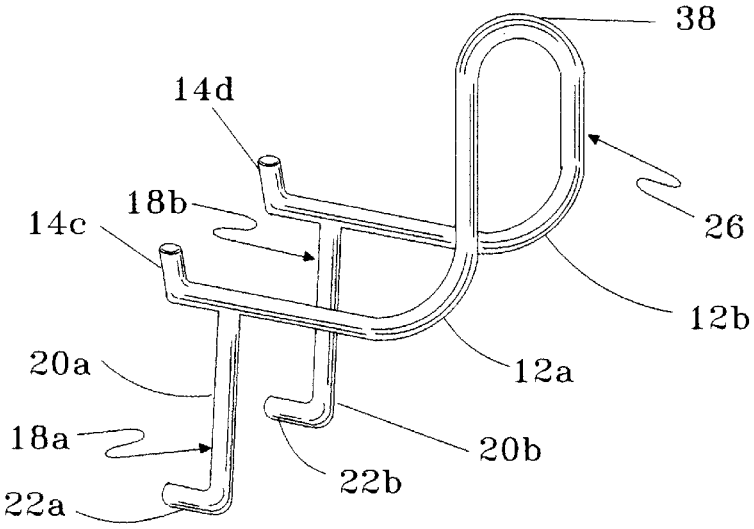
Figure 8:
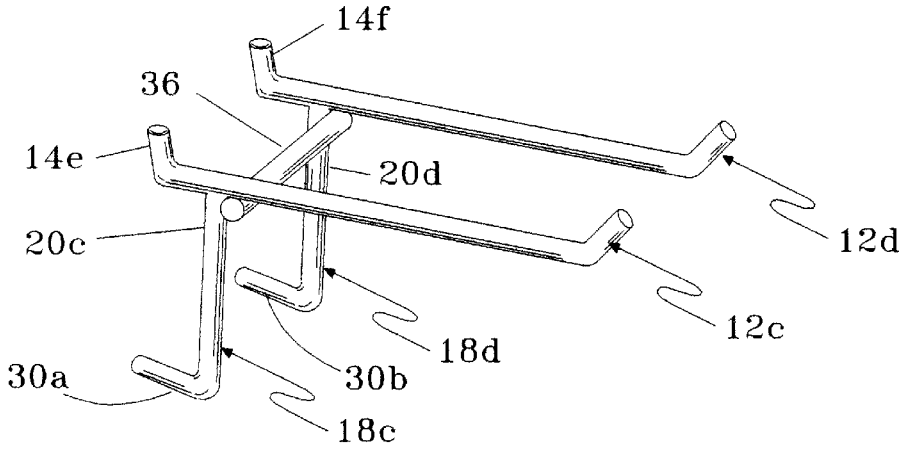

FIGS. 7 and 8 Perspective views of some other pegboard accessories using various embodiments of the invention.

REFERNCE NUMERALS IN DRAWINGS

10 pegboard
11 Aperture opening
12 Support member
14 "L" hook
18 Restraining member
20 Vertical restraint
22 Short stub

24 Support member
26 Load Support
28 Restraining arm
30 Long stub
31 Bracket
34 Spacer
36 Tie rod
38 Semi-circular member

SUMMARY

In accordance with the present invention a stay-put pegboard accessory comprises a support member having a "L" hook, and by means of attachment connected to a restraining member comprising of a vertical restraint and a short or long stub.

Description—FIGS. 1 & 2

A typical embodiment of the invention is directed to the pegboard accessory shown in the perspective and sectional views FIGS. 1 & 2 . The pegboard accessory composes of a support member 12 and a "L" hook 14, and by means of attachment to the support member 12 is a restraining member 18. The restraining member 18 consist of a vertical restraint 20 and either a short stub 22 or a long stub 30 as seen in FIG. 4.

Operation—FIGS. 1 & 2

The pegboard accessory is installed, as seen in FIGS. 1 & 2, by inserting the "L" hook 14 into aperture opening 11*a* and inserting the short stub 22 into aperture opening 11*b* of the pegboard 10. An item placed or stored on the support member 12 will cause the restraining member 18 to be forced into the face of the pegboard 10 and the "L" hook 14 to be forced into the back of the pegboard 10. When the item or object is removed from the pegboard accessory, and if in the process of removing the item a force is applied against the support member 12, at any angle with respect to the face of the pegboard 10, the pegboard accessory will stay on the pegboard 10 and not be pulled off. The forces will be restrained by the "L" hook 14 and the restraining member 18 will be forced into the face of the pegboard 10. The restraining member 18 also serves to prevent the support member 12 from being twisted by a side force applied to the support member 12. If aperture openings 11*a* or 11*b* become enlarged for various reasons, it does not affect the holding power of the pegboard accessory. It will not be pulled off the pegboard 10. This is due to the location of the "L" hook 14 with respect to the support member 12 being in line with or slightly above or below. The location of the short stub 22 can be located one or more aperture openings 11*b* below the "L" hook 14.

Description—FIGS. 3, 4, 5, and 6

The invention is directed to the perspective and elevation views of FIGS. 3, 4, 5, and 6 showing other embodiments of the invention. The pegboard accessory shows a support member 24, a restraining arm 28, a long stub 30 and by means of attachment to the support member 24 is a bracket 31 consisting of "L" hooks 14*a* and 14*b*. The location of the long stub 30 can be located one or more aperture openings 11*e* below the "L" hook 14*a* and 14*b*.

Operation—FIGS. 3, 4, 5, and 6

The pegboard accessory is installed, as seen in FIGS. 3, 4, 5, and 6, by inserting the "L" hooks 14*a* and 14*b* into aperture openings 11*c* and 11*d* and inserting the long stub 30 into lower aperture opening 11*e* of the pegboard 10*a*. The performance of this pegboard accessory embodiment is similar to the one described in FIGS. 1 & 2 with the same design features.

In FIG. 4 attention is called to the long stub 30. The long stub 30 is designed to form an angle with the restraining arm 28 which has a distance from pivot point A to point B equal to the distance of point A to point C. Therefore the distance of a point midway between B and C to point A is less than either A–B or A–C. This requires the long stub 30 to be forced into aperture opening 11*e* causing a wedging into the aperture opening 11*e* as shown in FIG. 5 to cause a tight fit to resist accidental removal from an uplift force imparted on the support member 24 of the pegboard accessory.

In FIG. 6 the invention is directed to the long stub 30 which allows spacers 34 to be placed on the long stub 30 between the pegboard 10*a* and the restraining arm 28. This allows the support member 24 to be tilted upward to prevent a heavy object D placed on the support member 24 from deflecting the support member 24 and sliding down and off the support member 24.

When heavy loads are applied to the support member 24, the long restraining arm 28 will transfer a smaller load to the pegboard 10*a* and will minimize deflection of the pegboard 10*a*, than if the restraining arm 28 was short.

Description—FIG. 7

The invention is directed to the pegboard accessory shown in FIG. 7 in perspective view showing another embodiment for the invention. The pegboard accessory comprises of a load support 26 containing support members 12*a* and 12*b*, "L" hooks 14*c* and 14*d*, a semi-circular member 38 and by means of attachment to support member 12*a* and 12*b* are restraining members 18*a* and 18*b*. The restraining members 18*a* and 18*b* consist of vertical restraints 20*a* and 20*b* and short stubs 22*a* and 22*b*.

Operation—FIG. 7

This will produce a pegboard accessory shown in FIG. 7 for holding extension cords, hoses or the like. Forces acting on the pegboard accessory will act the same as described in FIG. 1 without pulling the pegboard accessory off the pegboard.

Description—FIG. 8

The invention is directed to the pegboard accessory shown in FIG. 8 in perspective view showing another embodiment for the invention. The pegboard accessories contains a plurality of support members 12*c* and 12*d* containing "L" hooks 14*e* and 14*f* and by means of attachment to support members 12*c* and 12*d* are restraining members 18*c* and 18*d*. The restraining members 18*c* and 18*d* consists of vertical restraints 20*c* and 20*d* and long stubs 30*a* and 30*b*. The two assemblies by means of attachment are connected with a tie rod 36.

Operation—FIG. 8

The long stubs 30*a* and 30*b* provide a wedging action in the aperture openings of the pegboard, as described above, and will resist an upward force imparted on the support member 12*c* and 12*d* while removing an item from the accessory.

Conclusion, Ramifications, and Scope

Accordingly, the reader will see that the stay-put pegboard accessory invention will allow the accessory to remain on the pegboard with various forces acting on the support member without the fear of having the accessories fall off the pegboard. Furthermore the stay-put pegboard accessories have the additional advantages in that They will not be accidentally removed if the aperture openings become enlarged.

They can be relocated on the pegboard with ease with one hand operation.

They can be fabricated, molded or cast at a reasonable cost.

They are fabricated as a one piece assembly without loose parts to become lost.

They will increase their holding power on the pegboard when a load is applied.

The accessories designed for lighter pegboards can be used on the heavier pegboards.

They do not present a safety hazard by not being pulled off the pegboard.

They will minimize the deflection of the pegboard with heavy loads.

Although the description above contains many specificities, these should not be construed as limiting the scope of the invention but as merely providing illustrations of some of the presently preferred embodiments of this invention. For example, the pegboard accessories can have other shapes for various applications, some as shown in FIGS. 3, 4, 5, 6, 7 and 8

Thus the scope of the invention should be determined by the appended claims and their legal equivalents, rather than by the examples given.

I claim:

1. A stay-put pegboard accessory in combination with an apertured panel with front and back face surfaces and spaced apertures therethrough, said stay-put accessory being one piece having a support member and a restraining member;

(A) said support member comprising a formed upward curved hook and an L-hook;

(B) said formed upward curved hook being located directly adjacent to the L-hook at an elevation near the elevation of said L-hook and extending above said L-hook;

(C) said L-hook to be received in and held by an upper aperture in said apertured panel;

(D) said restraining member being located below said support member and attached to said support member, said restraining member including a vertical member having a uniform cross-section without bend points and a short stub, said short stub being elongated and substantially the same diameter as said apertures and forming an acute angle with said vertical member, whereby said elongated stub becomes wedged upon insertion into one of said apertures providing additional holding power for said restraining member from being disengaged from said apertured panel;

(E) said short stub to be inserted in a lower aperture of said apertured panel, whereby said L-hook will rest against the back face surface of said apertured panel, whereby a pulling force acting on said formed upward curved hook will be resisted by said L-hook and will cause said restraining member to be pushed against said apertured panel thereby holding said stay-put pegboard accessory in place, whereby said short stub restrains said restraining member from twisting on said apertured panel.

* * * * *